US010613481B2

(12) United States Patent
Iguchi

(10) Patent No.: US 10,613,481 B2
(45) Date of Patent: Apr. 7, 2020

(54) CROWN LOCK MECHANISM-INSTALLED TIMEPIECE

(71) Applicant: Seiko Instruments Inc., Chiba-shi, Chiba (JP)

(72) Inventor: Katsunobu Iguchi, Chiba (JP)

(73) Assignee: Seiko Instruments Inc., Chiba-shi (JP)

( * ) Notice: Subject to any disclaimer, the term of this patent is extended or adjusted under 35 U.S.C. 154(b) by 161 days.

(21) Appl. No.: 15/914,438

(22) Filed: Mar. 7, 2018

(65) Prior Publication Data

US 2018/0259906 A1 Sep. 13, 2018

(30) Foreign Application Priority Data

Mar. 13, 2017 (JP) ..... 2017-047502

(51) Int. Cl.
*G04B 3/04* (2006.01)

(52) U.S. Cl.
CPC ..... *G04B 3/043* (2013.01); *G04B 3/041* (2013.01); *G04B 3/046* (2013.01)

(58) Field of Classification Search
CPC ..... G04B 3/043; G04B 3/041; G04B 3/046; G04B 37/103; G04B 37/04
USPC ..... 368/308
See application file for complete search history.

(56) References Cited

U.S. PATENT DOCUMENTS 3,614,865 A * 10/1971 Wuthrich ..... G04B 37/066 368/289
3,866,407 A * 2/1975 Wuthrich ..... G04B 19/25 368/35
2004/0071049 A1* 4/2004 Hiranuma ..... G04B 37/04 368/319
2005/0007891 A1* 1/2005 Hiranuma ..... G04B 37/103 368/318
2005/0088920 A1* 4/2005 Hiranuma ..... G04B 37/103 368/319
2005/0094498 A1* 5/2005 Koshoji ..... G04B 3/043 368/319
2010/0220562 A1* 9/2010 Hozumi ..... G04B 3/043 368/308
2014/0286146 A1* 9/2014 Sakurazawa ..... G04B 3/043 368/308

FOREIGN PATENT DOCUMENTS

JP H08-248148 A 9/1996

* cited by examiner

*Primary Examiner* — Edwin A. Leon
(74) *Attorney, Agent, or Firm* — Brinks Gilson & Lione

(57) ABSTRACT

There is provided a crown lock mechanism-installed timepiece which enables a lock mechanism to regulate an operation of a crown by using a simple operation. A crown lock mechanism includes a winding stem, a crown, a lock screw ring, an extrusion spring, and a regulator. The winding stem is connected to a corrector lever of a movement. The crown is fixed to the winding stem. The crown is capable of engaging with the lock screw ring, and the crown is supported by the lock screw ring so as to be movable in an axial direction. The extrusion spring biases the lock screw spring toward the crown. The regulator regulates the lock screw ring to be located at a predetermined position against a biasing force of the extrusion spring, and holds the crown engaging with the lock screw ring so as to stay at a normal hand operation position.

6 Claims, 7 Drawing Sheets

CROWN LOCK MECHANISM-INSTALLED TIMEPIECE

RELATED APPLICATIONS

This application claims priority under 35 U.S.C. § 119 to Japanese Patent Application No. 2017-047502 filed on Mar. 13, 2017, the entire content of which is hereby incorporated by reference.

BACKGROUND OF THE INVENTION

1. Field of the Invention

The present invention relates to a crown lock mechanism-installed timepiece.

2. Description of Related Art

A timepiece is known which includes a crown pipe connected to a winding stem so as to be movable in an axial direction, a crown attached to the crown pipe, and an elastic member interposed between the winding stem and the crown. A biasing force of the elastic member is applied to the winding stem and the crown, thereby suppressing rattling of the crown.

When the timepiece is switched to a time correction mode, the crown unscrewed and decoupled (disengaged) from a screw portion of the winding stem pipe is pulled out to a time correction position. On the other hand, when the crown is held in a normal hand operation mode, the crown is pushed so that the winding stem is switched to the normal hand operation mode by using the biasing force of the elastic member.

Furthermore, a so-called lock mechanism for preventing a malfunction of the crown is known.

This lock mechanism regulates the crown so as not to be further pushed by screwing and coupling the crown to the screw portion of the winding stem pipe, thereby preventing the malfunction of the crown (for example, refer to JP-A-8-248148 (Patent Reference 1)).

However, when the crown is locked, the screw portion of the winding stem pipe needs to interlock with the crown by pushing the crown against the biasing force of the elastic member. Furthermore, the crown needs to be screwed and coupled to the screw portion of the winding stem pipe while a pushing force is applied to the crown.

Here, when the winding stem is switched from a correction state to the normal hand operation mode, it is necessary to operate the corrector lever by transmitting the pushing force of the crown to the winding stem via the elastic member. Here, if an elastic force of the elastic member is weak, the pushing force of the crown is not sufficiently transmitted to the corrector lever. Accordingly, the biasing force of the elastic member is secured so as to be relatively strong. Therefore, the crown needs to be screwed and coupled to the screw portion of the winding stem pipe while the strong pushing force is applied to the crown. From this point of view, there is room for improvement in operability.

SUMMARY OF THE INVENTION

The present invention is made in view of these circumstances, and an object thereof is to provide a crown lock mechanism-installed timepiece which enables a lock mechanism to regulate an operation of a crown by using a simple operation.

According to an aspect of the present invention, in order to solve the above-described problem, there is provided a crown lock mechanism-installed timepiece including a winding stem that is connected to a corrector lever of a movement, a crown that is fixed to the winding stem coaxially with a central axis of the winding stem, and that is movable to a normal hand operation position and a time correction position along an axial direction of the winding stem, a lock portion with which the crown is capable of engaging, and by which the crown is supported so as to be movable along the axial direction, an elastic member that biases the lock portion toward the crown, and a regulator that regulates the lock portion to be located at a predetermined position against a biasing force of the elastic member, and that holds the crown engaging with the lock portion so as to stay at the normal hand operation position.

According to this configuration, the winding stem and the crown can be integrated with each other by fixing the crown to the winding stem. That is, it is not necessary to interpose the elastic member between the winding stem and the crown as in the related art. Accordingly, the crown is pushed into the normal hand operation position, thereby enabling the crown to directly push the winding stem. The winding stem is pushed, thereby enabling the corrector lever to be switched to a normal hand operation mode. In addition, the crown is held to stay at the normal hand operation position by using the holding force of the corrector lever.

When the crown is caused to engage with the lock portion in this state, the pushing force acting against the elastic member which is needed in the related art does not need to be applied to the crown. In this manner, a lock mechanism can regulate an operation of the crown by using a simple operation.

In the above-described aspect, a male screw may be formed in one of the crown and the lock portion, and a female screw capable of engaging with the male screw is formed in the other one of the crown and the lock portion.

According to this configuration, the crown rotates at the normal hand operation position, thereby screwing and coupling the crown to the lock portion. In this manner, a configuration in which the crown engages with the lock portion can be simply realized by forming screws in the lock portion and the crown.

In the above-described aspect, the lock portion may interlock with the crown by using the biasing force of the elastic member in a state where the crown is disposed at the normal hand operation position and disengages from the lock portion.

According to this configuration, in a state where the crown and the lock portion disengage from each other at the normal hand operation position, the lock portion interlocks with the crown by using the biasing force of the elastic member. Accordingly, the crown is rotated, thereby screwing and coupling the crown to the lock portion. In this manner, the lock mechanism can regulate the operation of the crown by using the simpler operation.

In the above-described aspect, in a state where the crown and the lock portion disengage from each other, the biasing force of the elastic member may be weaker than a holding force of the corrector lever which holds the crown at the normal hand operation position.

According to this configuration, the biasing force of the elastic member is transmitted to the crown via the lock portion. On the other hand, the crown is held at the normal hand operation position via the winding stem by using the holding force of the corrector lever. The biasing force of the elastic member is set to be weaker than the holding force of the corrector lever. Accordingly, even if the biasing force of the elastic member is applied to the lock portion, the crown can be held at the normal hand operation position by using the holding force of the corrector lever.

In the above-described aspect, in a state where the crown is disposed at the time correction position, the crown may be separated from the lock portion.

According to this configuration, the lock portion is separated from the crown. Accordingly, when the time is adjusted by rotating the crown, it is possible to prevent the crown from engaging with (being screwed and coupled to) the lock portion.

In the above-described aspect, the regulator may be formed from a groove portion which is formed along the axial direction, and an ear portion which is formed in the lock portion and is disposed so as to be movable inside the groove portion. The lock portion may be regulated to be located at the predetermined position by the ear portion coming into contact with the groove portion.

According to this configuration, the regulator is formed from the groove portion and the ear portion of the lock portion. In this manner, the regulator can adopt a simple configuration.

In addition, the ear portion of the lock portion is fitted to the groove portion. In this manner, the simple configuration of the groove portion and the ear portion can suppress the rotation of the lock portion in a circumferential direction with, and can allow the movement of the lock portion in the axial direction.

According to an aspect of the present invention, a lock mechanism can regulate an operation of a crown by using a simple operation.

DETAILED DESCRIPTION OF THE EMBODIMENTS

Hereinafter, an embodiment according to the present invention will be described with reference to the drawings.

First, a crown lock mechanism-installed timepiece according to the embodiment will be described.

In general, a machine body including a driving portion of a timepiece is referred to as a "movement". A state of a finished product by attaching a dial and hands to the movement and placing the movement in a timepiece case (body) is referred to as a "complete assembly" of the timepiece.

Figure 1:
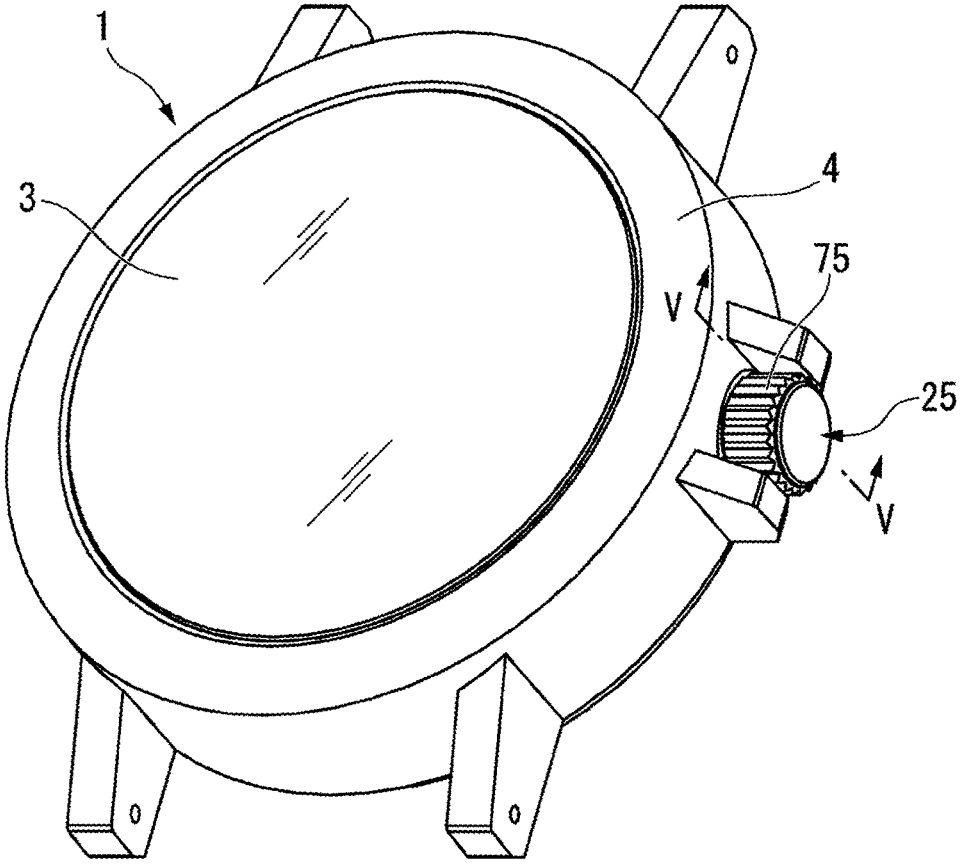
FIG. 1 is a perspective view illustrating a crown lock mechanism-installed timepiece according to an embodiment of the present invention.
Figure 2:
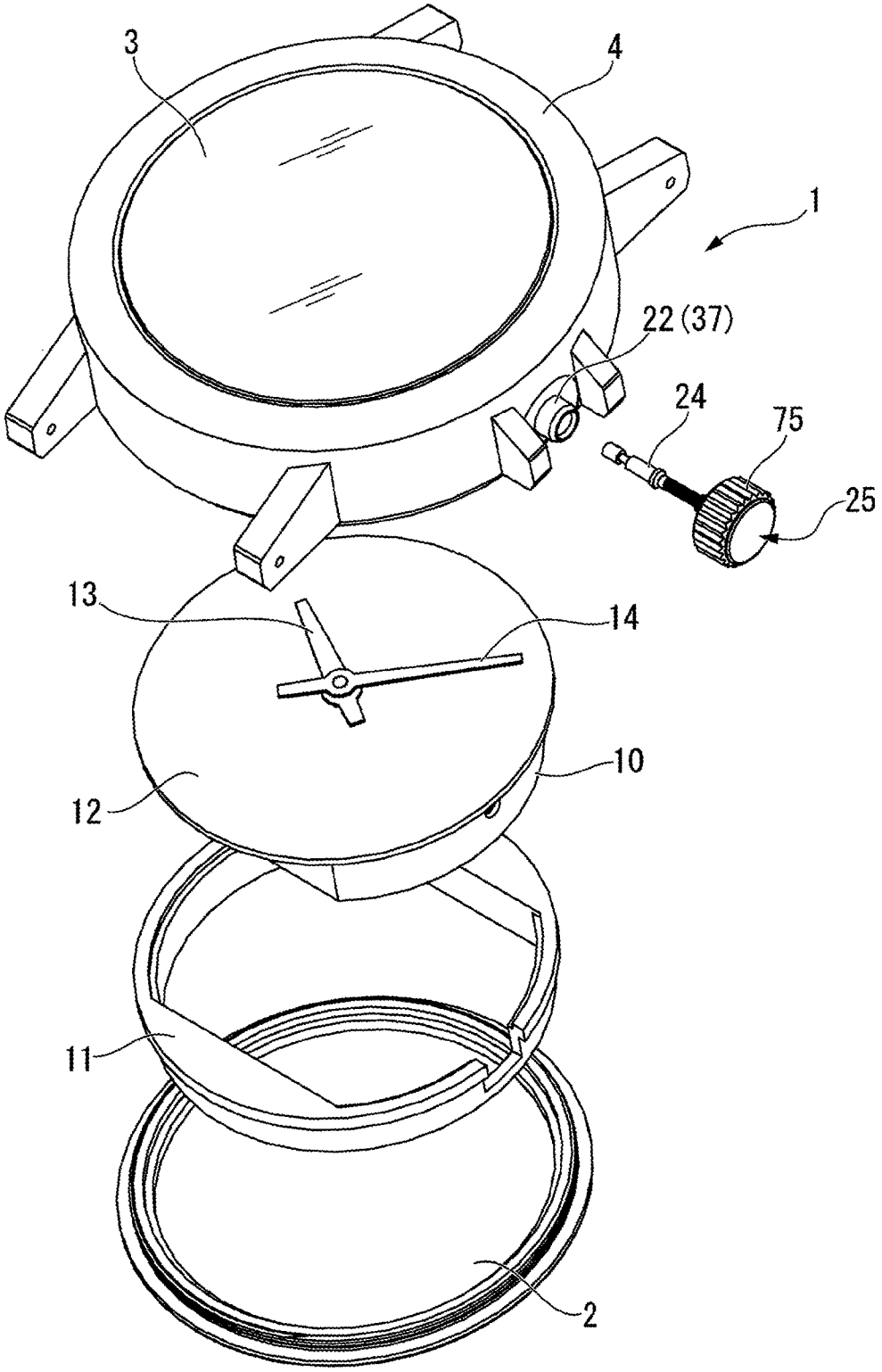
FIG. 2 is an exploded perspective view illustrating the crown lock mechanism-installed timepiece according to the embodiment of the present invention.

FIG. 1 is an external perspective view illustrating the timepiece according to the embodiment. FIG. 2 is an exploded perspective view illustrating the timepiece according to the embodiment. Hereinafter, a crown lock mechanism-installed timepiece 1 is abbreviated as a "timepiece 1".

As illustrated in FIGS. 1 and 2, in the complete assembly of the timepiece 1, an interior of a timepiece case 4 having a case back 2 and a glass 3 is provided with a movement 10, an intermediate frame 11, a dial 12, an hour hand 13, and a minute hand 14. The movement 10 is held in the interior of the timepiece case 4 by the intermediate frame 11. The dial 12 has a scale for indicating information relating to a time. In this manner, the time is visible through the timepiece 1.

In addition, a winding stem pipe 22 is disposed in a portion located at 3 o'clock on a side surface of the timepiece case 4. A crown 25 is disposed via a winding stem 24 in the winding stem pipe 22. The crown 25 is provided for operating the movement 10 from the outside of the timepiece case 4, and is integrated with the winding stem 24 inserted into the timepiece case 4. The winding stem 24 is disposed so as to be rotatable around an axis with respect to the timepiece case 4. The crown 25 is operated, thereby enabling the timepiece 1 to switch a normal hand operation mode and a time correction mode for correcting the time indicated by the hour hand 13 and the minute hand 14.

Figure 3:
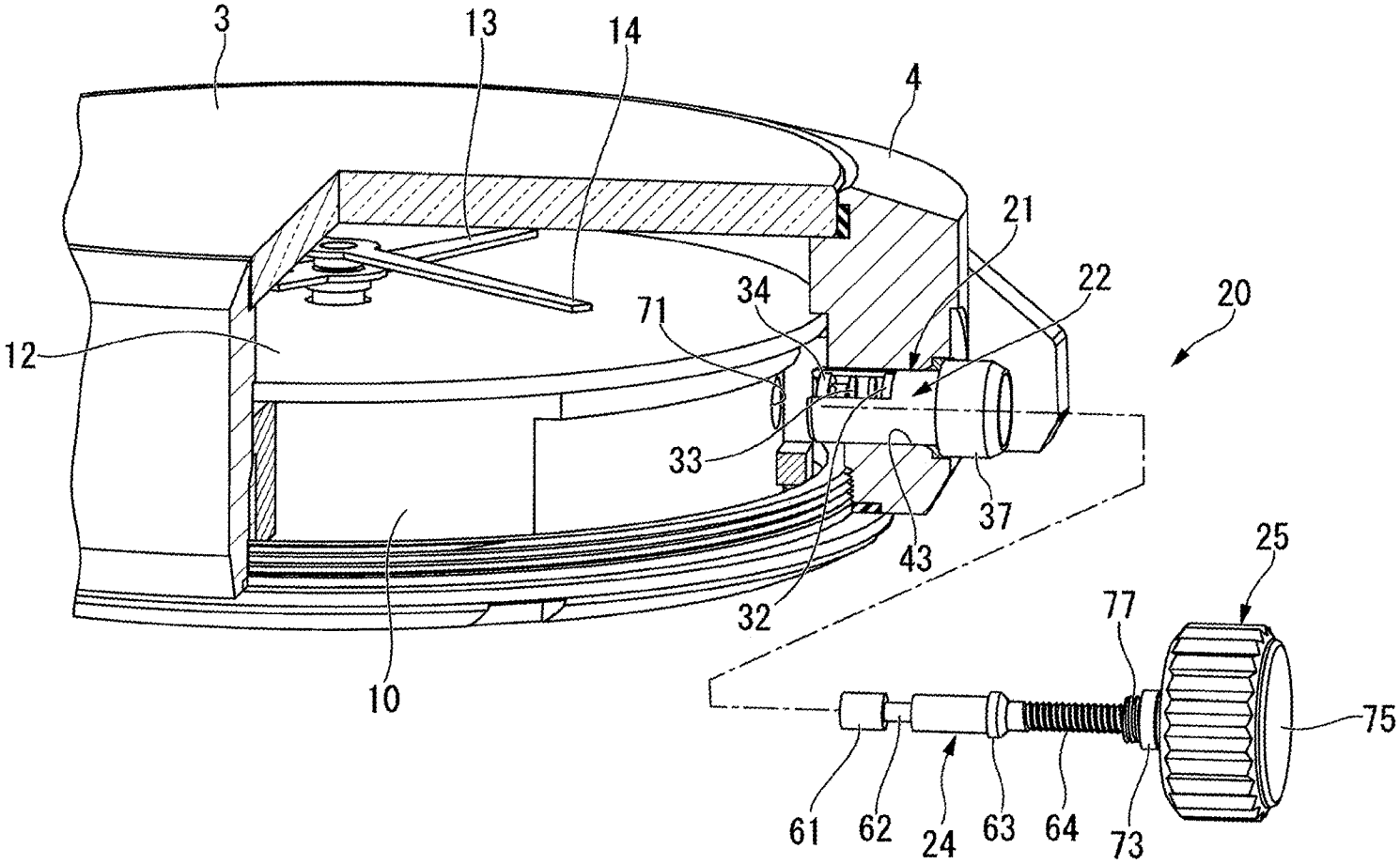
FIG. 3 is a perspective view illustrating a state in which the crown lock mechanism-installed timepiece is partially broken according to the embodiment of the present invention.
Figure 4:
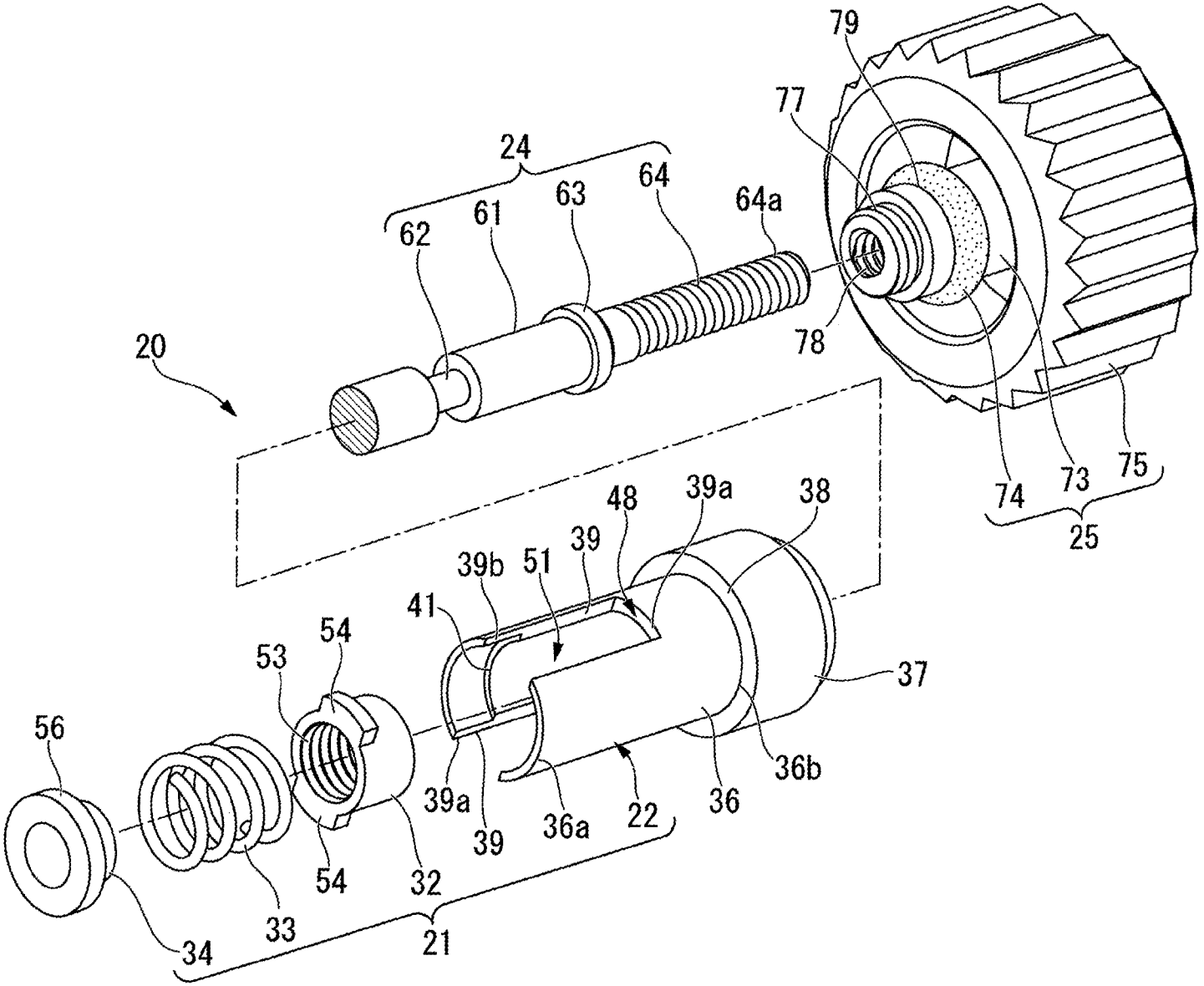
FIG. 4 is an exploded perspective view illustrating a crown lock mechanism according to the embodiment of the present invention.

FIG. 3 is a perspective view illustrating a state where the timepiece is partially broken according to the embodiment. FIG. 4 is an exploded perspective view illustrating a crown lock mechanism 20 according to the embodiment.

As illustrated in FIGS. 3 and 4, the crown lock mechanism 20 includes a winding stem pipe unit 21 supported by the timepiece case 4, the winding stem 24 supported by a main plate of the movement 10, and the crown 25 fixed to the winding stem 24.

The winding stem pipe unit 21 includes a winding stem pipe 22, a lock screw ring 32, an extrusion spring 33, and a washer pipe 34.

The winding stem pipe 22 is entirely formed in a cylindrical shape, and has an insertion portion 36, an enlarged diameter portion 37, an outer step portion 38, a pair of split groove portions 39, and a pair of inner step portions 41.

Figure 5:
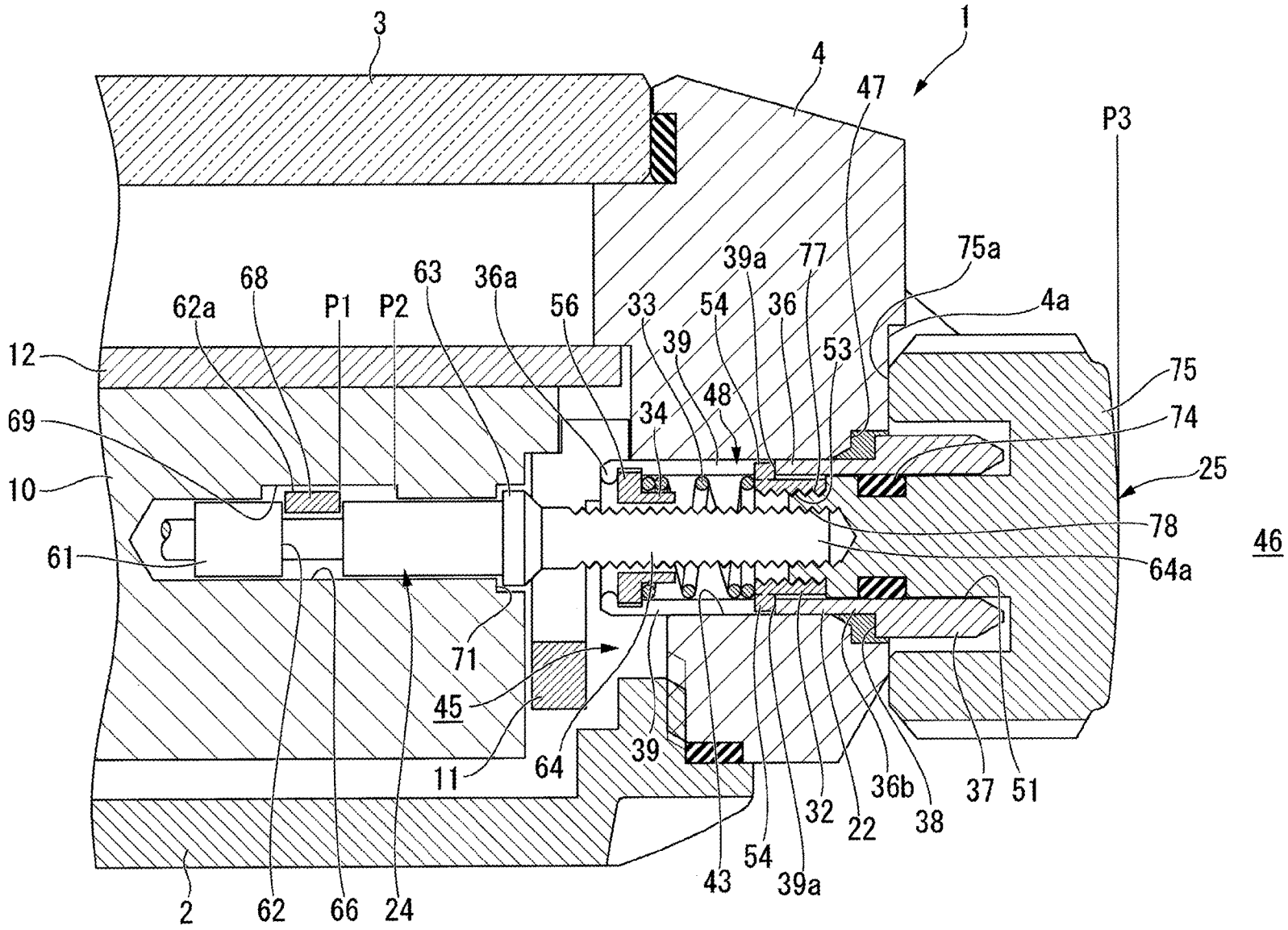
FIG. 5 illustrates a state where a crown is locked at a normal hand operation position according to the embodiment of the present invention, and is a sectional view taken along line V-V in FIG. 1.

FIG. 5 is a sectional view taken along line V-V in FIG. 1 according to the embodiment.

As illustrated in FIG. 5, the insertion portion 36 is fitted into a through-hole 43 of the timepiece case 4, thereby causing an inner end portion 36*a* of the insertion portion 36 to protrude to an interior 45 of timepiece case 4 after passing through the through-hole 43. In addition, the enlarged diameter portion 37 is formed in an outer end portion 36*b* of the insertion portion 36, and protrudes from an outer surface 4*a* of the timepiece case 4 to an exterior 46 of the timepiece case 4. The outer step portion 38 is formed in an outer periphery of the winding stem pipe 22 by the insertion portion 36 and the enlarged diameter portion 37.

In the winding stem pipe 22, in a state where the insertion portion 36 is fitted into the through-hole 43, the outer step portion 38 is fixed to a step portion 47 of the timepiece case 4 by means of brazing or by using an adhesive.

Referring back to FIG. 4, the pair of split groove portions 39 is formed at an equal interval of 180° in the circumferential direction. In the pair of split groove portions 39, the inner end portion 39*b* is open, and the pair of split groove portions 39 extends in the axial direction of the winding stem pipe 22 while maintaining a constant width dimension from the inner end to the center (that is, a groove bottom portion 39*a*). In the split groove portion 39, the groove bottom portion 39*a* is formed at the center of the winding stem pipe 22. The split groove portion 39 forms a portion of the regulator 48 (to be described later).

The pair of inner step portions 41 is formed in the inner end portion of the winding stem pipe 22.

The lock screw ring 32 is accommodated in an interior 51 of the winding stem pipe 22. The lock screw ring 32 is formed in an annular shape, and has a lock female screw portion 53 and a pair of ear portions 54.

The lock female screw portion 53 is formed in an inner periphery of the lock screw ring 32. The pair of ear portions 54 is formed in the inner end of the lock screw ring 32 and in the outer periphery. The pair of ear portions 54 is fitted into the split groove portion 39 so as to be movable in the axial direction of the winding stem pipe 22. The ear portion 54 is fitted into the split groove portion 39, thereby suppressing the rotation of the lock screw ring 32 in the circumferential direction.

In this way, a simple configuration in which the ear portion 54 of the lock screw ring 32 is fitted into the split groove portion 39 can suppress the rotation of the lock screw ring 32 in the circumferential direction, and can allow the movement of the lock screw ring 32 in the axial direction.

In addition, the pair of ear portions 54 comes into contact with the groove bottom portion 39*a* of the pair of split groove portions 39, thereby regulating the lock screw ring 32 to stay at a predetermined position. That is, the regulator 48 is formed from the pair of split groove portions 39 and the pair of ear portions 54. The regulator 48 is formed by using the pair of split groove portion 39 and the pair of ear portions 54, thereby enabling the regulator 48 to adopt a simple configuration.

The extrusion spring 33 is accommodated in the interior 51 of the winding stem pipe 22 and on the inner end portion side of the winding stem pipe 22 from the lock screw ring 32. The extrusion spring 33 is disposed coaxially with the winding stem pipe 22, and one end (end portion on the crown 25 side) of the extrusion spring 33 comes into contact with the lock screw ring 32. The extrusion spring 33 is a compression coil spring.

The washer pipe 34 is accommodated in the interior 51 of the winding stem pipe 22 and on the inner end portion side of the winding stem pipe 22 from the extrusion spring 33. The washer pipe 34 comes into contact with the other end of the extrusion spring 33. The washer pipe 34 is formed in an annular shape, and has a washer flange 56 which protrudes from the inner end portion in a radial direction.

The washer flange 56 of the washer pipe 34 comes into contact with the inner step portion 41, and the inner end portion (that is, the inner end portion of the insertion portion 36) 36*a* of the winding stem pipe 22 is tightened inward in the radial direction. Accordingly, the washer pipe 34 is fixed to the inner end portion 36*a* of the winding stem pipe 22.

As illustrated in FIG. 5, the washer pipe 34 is fixed to the inner end portion 36*a* of the winding stem pipe 22. In this manner, the lock screw ring 32 is biased against the crown 25 side by the extrusion spring 33. Accordingly, the pair of ear portions 54 of the lock screw ring 32 is held in a state of being in contact with the regulator 48 of the winding stem pipe 22.

In this manner, in the winding stem pipe unit 21, the winding stem pipe 22, the lock screw ring 32, the extrusion spring 33, and the washer pipe 34 are integrally unitized. In the winding stem pipe unit 21, the winding stem pipe 22 is supported by the timepiece case 4.

As illustrated in FIGS. 4 and 5, the winding stem 24 is entirely formed in a cylindrical shape, and has a fitting portion 61, an annular recess portion 62, a winding stem flange 63, and a winding stem screw portion 64.

The fitting portion 61 is fitted into a main plate fitting hole 66 of the movement 10. In this manner, the fitting portion 61 is rotatable in the circumferential direction, and is supported to be movable in the axial direction.

The annular recess portion 62 is formed in the middle of the fitting portion 61. The annular recess portion 62 is an annular recess portion formed in a shape recessed toward the axial center from the outer peripheral surface of the fitting portion 61. The corrector lever 68 is disposed in the annular recess portion 62. A step portion 69 of the movement 10 is disposed on an opposite side surface 62*a* of the annular recess portion 62 in the corrector lever 68.

Accordingly, the corrector lever 68 is connected to the annular recess portion 62 in the step portion 69 of the movement 10. In this manner, in the corrector lever 68, the winding stem 24 moves in the axial direction, thereby allowing the corrector lever 68 to switch between a normal hand operation position P1 serving as a normal hand movement mode and a time correction position P2 serving as a time correction mode for correcting the time.

In a state where the corrector lever 68 is disposed at the normal hand operation position P1, meshing between a clutch wheel and a setting wheel for correcting the time is released. On the other hand, in a state where the corrector lever 68 is disposed at the time correction position P2, the clutch wheel and the setting wheel mesh with each other so as to enable time correction.

The winding stem flange 63 is formed in the outer end portion of the fitting portion 61. The diameter of the winding stem flange 63 is enlarged in a circular shape outward from the fitting portion 61 in the radial direction. Since the diameter of the winding stem flange 63 is enlarged in the circular shape, the winding stem flange 63 is accommodated in the recess portion 71 of the movement 10 so as to be rotatable around the axis.

The winding stem flange 63 is accommodated in the recess portion 71, thereby causing the corrector lever 68 to be disposed at the normal hand operation position P1 in the normal hand operation mode. On the other hand, the winding stem flange 63 is separated from the recess portion 71, thereby causing the corrector lever 68 to move to the time correction position P2 in the time correction mode.

The winding stem screw portion 64 protrudes from the winding stem flange 63. The winding stem screw portion 64 extends in a direction away from the movement 10, and a male screw is formed in the outer periphery. The winding stem screw portion 64 is inserted into each interior of the washer pipe 34, the extrusion spring 33, and the lock screw ring 32.

The crown 25 engages with the winding stem screw portion 64 of the winding stem 24 by means of screwing and coupling. The crown 25 has an axle portion 73 fitted to the winding stem pipe 22, a crown gasket 74 disposed in the axle portion 73, and a head portion 75 formed in the outer end portion of the axle portion 73.

The axle portion 73 is coaxially accommodated in the interior 51 of the winding stem pipe 22. The axle portion 73 is movable in the axial direction, and is supported by the winding stem pipe 22 so as to be rotatable in the circumferential direction.

The axle portion 73 has a crown male screw portion 77 formed in the outer periphery of the inner end portion, a crown female screw portion 78 formed in the inner periphery of the inner end portion, and an annular groove portion 79 formed in the outer periphery between the inner end portion and the outer end portion.

The crown male screw portion 77 and the crown female screw portion 78 are formed coaxially with the axle portion 73. A tip portion 64*a* of the winding stem screw portion 64 is screwed and coupled to the crown female screw portion 78. In this state, the winding stem screw portion 64 is integrally fixed to the axle portion 73.

That is, the crown 25 is disposed coaxially with the central axis of the winding stem 24, and is integrally fixed to the winding stem 24. Accordingly, the length of the winding stem 24 can be adjusted by adjusting a screwing amount of the tip portion 64*a* of the winding stem screw portion 64 screwed into the crown female screw portion 78. In this manner, the length of the winding stem 24 is no longer limited, thereby enabling the winding stem 24 to be applied to various types of the timepiece.

In addition, the crown male screw portion 77 is detachably screwed and coupled to the lock female screw portion 53 of the lock screw ring 32. Accordingly, the crown 25 is rotated around the central axis of the winding stem 24, thereby causing the crown 25 to engage with the lock screw ring 32 by means of screwing and coupling.

In this manner, a configuration in which the crown 25 detachably engages with the lock screw ring 32 can be simply realized by forming screws in the lock screw ring 32 and the crown 25.

Furthermore, the crown gasket 74 is fitted into the annular groove portion 79. The crown gasket 74 is in contact with the inner periphery of the winding stem pipe 22 in a state of being fitted into the annular groove portion 79. In this manner, a gap between the inner periphery of the winding stem pipe 22 and the outer periphery of the axle portion 73 is sealed with the annular groove portion 79.

Here, the crown 25 is disposed at a normal hand operation position P3 serving as the normal hand operation mode. Since the crown 25 is disposed at the normal hand operation position P3, the corrector lever 68 is disposed at the normal hand operation position P1. In a state where the crown 25 is disposed at the normal hand operation position P3, an inner surface 75*a* of the head portion 75 of the crown 25 comes into contact with the outer surface 4*a* of the timepiece case 4.

In addition, the pair of ear portions 54 of the lock screw ring 32 comes into contact with the groove bottom portion 39*a* of the pair of split groove portions 39 by using the biasing force of the extrusion spring 33. The lock screw ring 32 is regulated to stay at a predetermined position.

In this state, the head portion 75 of the crown 25 is pinched with the fingers, and the head portion 75 is rotated in the clockwise direction. The crown 25 located at the normal hand operation position P3 is rotated around the axle portion 73 in the counterclockwise direction. Accordingly, the crown male screw portion 77 of the crown 25 is rotated in the counterclockwise direction. In the lock screw ring 32, the ear portion 54 engages with the split groove portion 39.

In this manner, the crown male screw portion 77 is rotated in the counterclockwise direction, thereby causing the lock female screw portion 53 (that is, the lock screw ring 32) in the crown male screw portion 77 to move to the movement 10 side against the biasing force of the extrusion spring 33.

The crown 25 is rotated as much as a predetermined amount, thereby causing the lock female screw portion 53 to be detached from the crown male screw portion 77.

Figure 6:
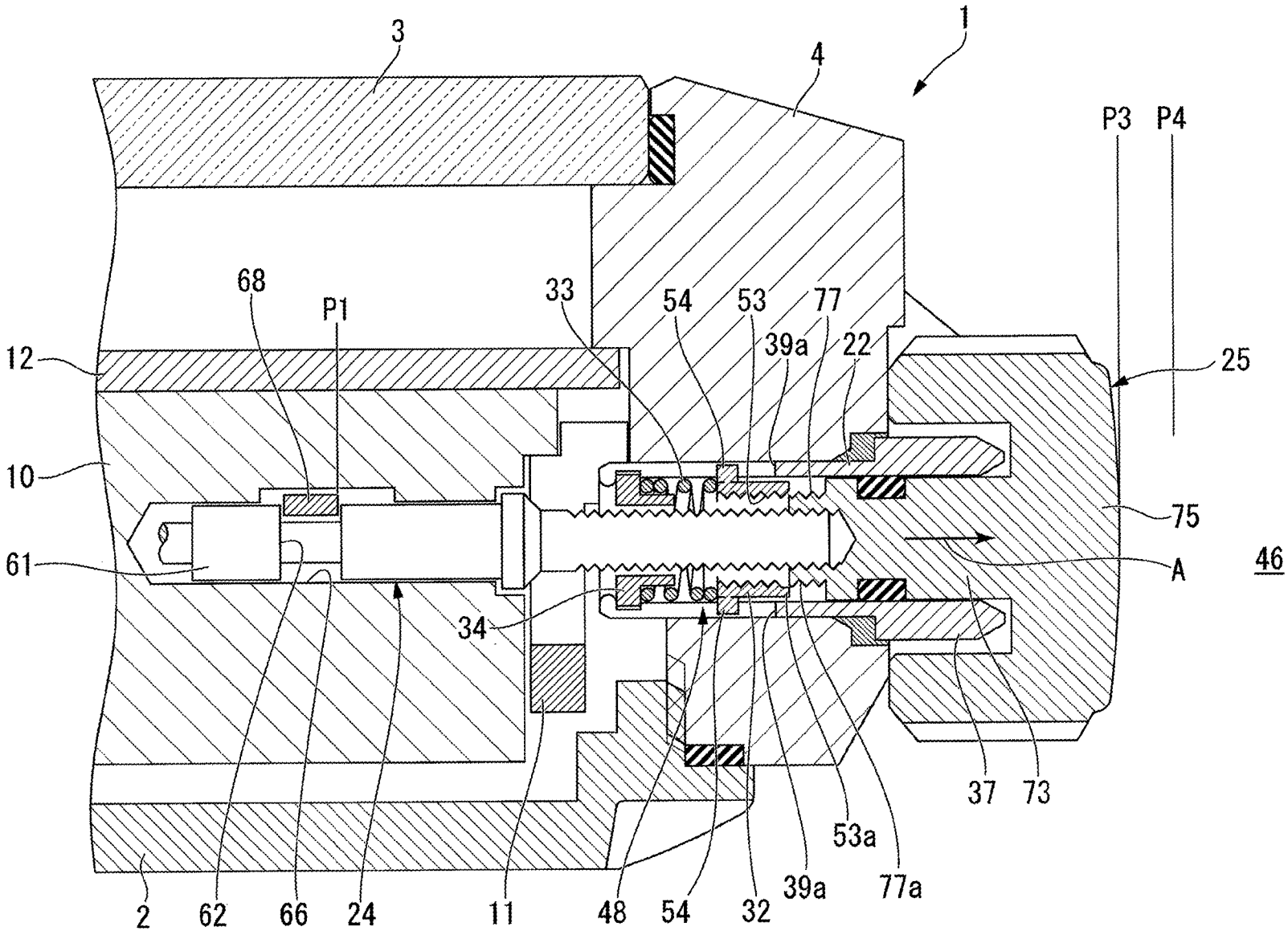
FIG. 6 is a sectional view illustrating a state where the crown is unlocked according to the embodiment of the present invention.

FIG. 6 is a sectional view illustrating a state where the crown 25 is unscrewed and decoupled from the lock screw ring 32 according to the embodiment.

As illustrated in FIG. 6, the crown 25 and the lock screw ring 32 disengage from each other by detaching the lock female screw portion 53 from the crown male screw portion 77. The ear portion 54 of the lock screw ring 32 is separated from the regulator 48. In this state, the extrusion spring 33 is compressed by the lock screw ring 32 and the washer pipe 34.

The biasing force of the compressed extrusion spring 33 holds a state where an outer end 53*a* of the lock female screw portion 53 interlocks with an inner end 77*a* of the crown male screw portion 77.

In this state, the corrector lever 68 is held at the normal hand operation position P1 by using a predetermined holding force. The biasing force of the compressed extrusion spring 33 is set to be weaker than the predetermined holding force of the corrector lever 68. In this manner, even if the biasing force of the extrusion spring 33 is applied to the axle portion 73 of the crown 25 via the lock screw ring 32 in a direction of an arrow A, the crown 25 can be held at the normal hand operation position P3 by using the holding force of the corrector lever 68.

The head portion 75 of the crown 25 is pinched with the fingers, and the crown 25 is pulled out one stage from the normal hand operation position P3 to a time correction position P4 serving as the time correction mode for correcting the time by using a force stronger than the predetermined holding force of the corrector lever 68.

Figure 7:
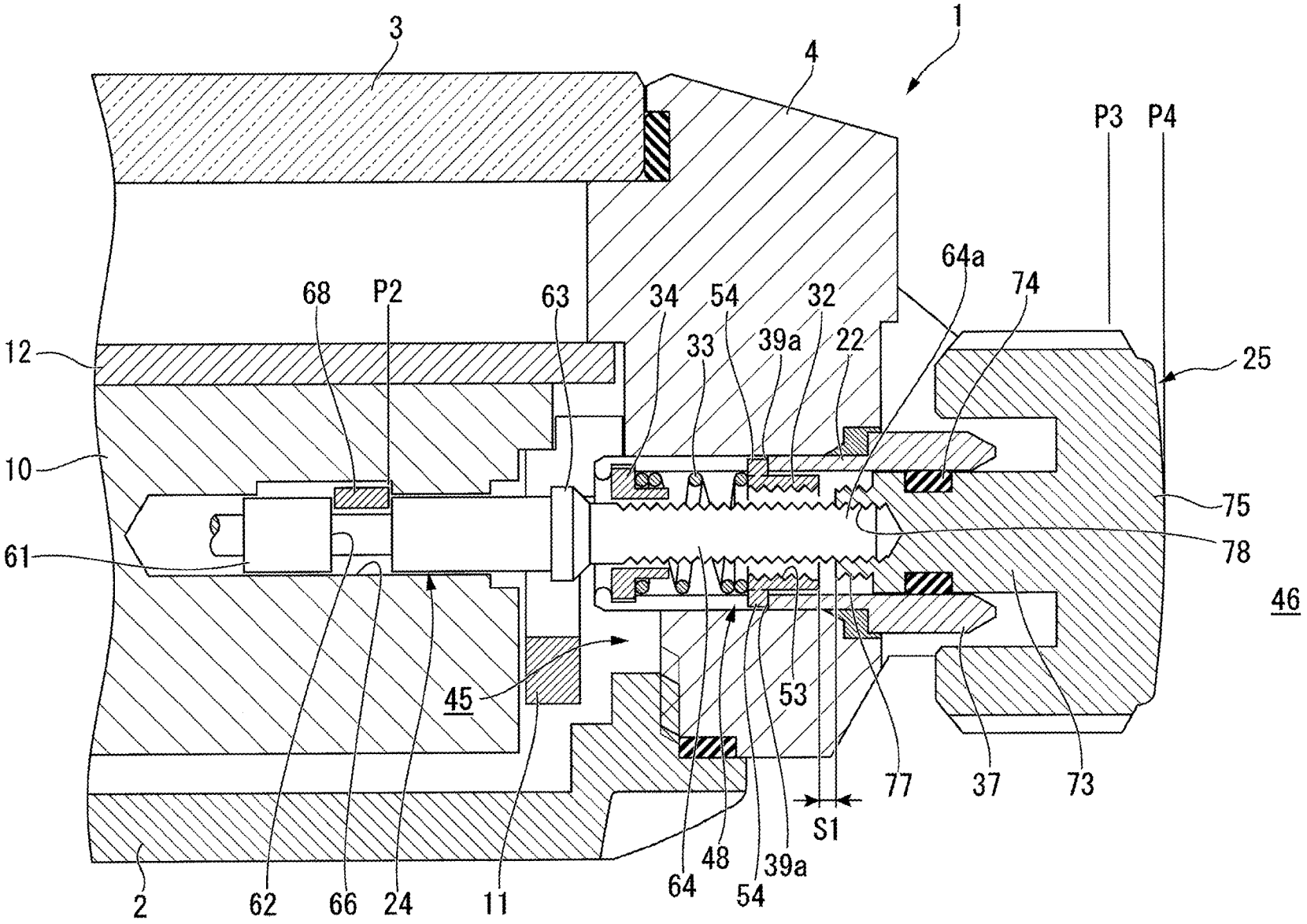
FIG. 7 is a sectional view illustrating a state where the crown is pulled out to a time correction position according to the embodiment of the present invention.

FIG. 7 is a sectional view illustrating a state where the crown 25 is switched to the time correction position P4 according to the embodiment.

As illustrated in FIG. 7, the crown 25 is switched from the normal hand operation position P3 to the time correction position P4. At the same time, the corrector lever 68 is switched from the normal hand operation position P1 to the time correction position P2, and the corrector lever 68 is held using the predetermined holding force.

The crown 25 is pulled to the time correction position P4, thereby bringing the ear portion 54 into contact with the regulator 48 by using the biasing force of the extrusion spring 33. Accordingly, the lock screw ring 32 is held at a predetermined position. In this manner, the axle portion 73 of the crown 25 can be separated as far as a predetermined interval S1 from the lock screw ring 32.

The crown 25 pulled out one stage to the time correction position P4 is held at the time correction position P4 by using the predetermined holding force of the corrector lever 68.

In this state, the head portion 75 of the crown 25 is pinched with the fingers, and the crown 25 is rotated around the axle portion 73 so as to correct the time indicated by the hour hand 13 and the minute hand 14 (refer to FIG. 2).

Here, the axle portion 73 of the crown 25 is held in a state of being separated as far as the predetermined interval S1 from the lock screw ring 32. Accordingly, when the time is adjusted by rotating the crown 25, it is possible to prevent the crown male screw portion 77 from being screwed and coupled to the lock female screw portion 53.

In addition, the tip portion 64*a* of the winding stem screw portion 64 is screwed and coupled to the crown female screw portion 78, thereby integrally fixing the winding stem 24 and the crown 25. In this manner, when the crown 25 pulled out one stage to the time correction position P4 is rotated so as to correct the time, it is possible to suppress an unsteady operation of the crown 25, and it is possible to improve operability.

Furthermore, when the crown 25 is unscrewed and decoupled from the lock screw ring 32, the crown 25 can be held at the normal hand operation position P3 by moving the lock screw ring 32 to the movement 10 side.

On the other hand, in some cases, a certain timepiece is locked at the normal hand operation position in a state where the crown is screwed and coupled to the winding stem pipe. In a case of this timepiece, in a state where the crown is unscrewed and decoupled from the winding stem pipe, the crown is disposed at a position protruding from the timepiece case.

In order to correct the time, the protruding crown needs to be pulled out one more stage, and thus, the pulling amount of the crown increases.

In contrast, the timepiece 1 according to the embodiment can hold the crown 25 at the normal hand operation position P3 in a state where the crown 25 is unscrewed and decoupled from the lock screw ring 32. Accordingly, in a state where the crown 25 is pulled out one stage from the normal hand operation position P3 to the time correction position P4, the pulling amount of the crown 25 can be minimized, compared to a timepiece including a normal lock mechanism. In this manner, for example, even in a case where the timepiece 1 is dropped in this state, it is possible to suppress damage to the crown 25 or the winding stem pipe.

Incidentally, when the crown 25 is switched from the time correction position P4 to the normal hand operation position P3, the crown 25 is pushed one stage from the time correction position P4 to the normal hand operation position P3 against the predetermined holding force of the corrector lever 68. While the crown 25 is pushed, the axle portion 73 of the crown 25 comes into contact with the lock screw ring 32. As the crown 25 is further pushed, the lock screw ring 32 is pushed toward the movement 10 side against the biasing force of the extrusion spring 33. Accordingly, the extrusion spring 33 is compressed.

Here, the biasing force of the compressed extrusion spring 33 is set to be weaker than the predetermined holding force of the corrector lever 68. Accordingly, the crown 25 can be easily pushed from the time correction position P4 to the normal hand operation position P3 against the biasing force of the extrusion spring 33 (refer to FIG. 6).

As illustrated in FIG. 6, after the crown 25 is pushed to the normal hand operation position P3, the crown 25 is rotated in the clockwise direction. In this state, as an extrusion force, the biasing force of the compressed extrusion spring 33 is applied to the crown 25 via the lock screw ring 32 in the direction of the arrow A.

Here, the biasing force of the compressed extrusion spring 33 is set to be weaker than the predetermined holding force of the corrector lever 68. The crown 25 is held at the normal hand operation position P3 by using the predetermined holding force of the corrector lever 68. That is, unlike the related art, the crown 25 does not need to be rotated in the clockwise direction while the crown 25 is pushed against the biasing force of the extrusion spring 33. In this manner, the crown 25 can be easily rotated in the clockwise direction.

In addition, the axle portion 73 of the crown 25 is in contact with the lock screw ring 32. That is, the inner end 77*a* of the crown male screw portion 77 is in contact with the outer end 53*a* of the lock female screw portion 53. In addition to this configuration, the lock female screw portion 53 is pressed against the crown male screw portion 77 by using the biasing force of the extrusion spring 33.

Accordingly, the crown 25 is rotated in the clockwise direction by pinching the head portion 75 of the crown 25 with the fingers. In this manner, the crown male screw portion 77 can be easily screwed and coupled to the lock female screw portion 53. The crown male screw portion 77 is screwed and coupled to the lock female screw portion 53, thereby causing the crown 25 to be locked at the normal hand operation position P3.

Furthermore, in a state where the crown 25 returns to the normal hand operation position P3, the crown male screw portion 77 can be screwed and coupled to the lock female screw portion 53 by rotating the crown 25 in the clockwise direction. Accordingly, the crown 25 does not need to be rotated while the crown 25 is pushed toward the movement 10 side. In this manner, it is easy to perform an operation in which the crown male screw portion 77 is screwed and coupled to the lock female screw portion 53.

As illustrated in FIG. 5, the crown male screw portion 77 is screwed and coupled to the lock female screw portion 53, thereby moving the lock screw ring 32 to the crown 25 side so that the ear portion 54 comes into contact with the regulator 48. In this manner, the crown 25 is locked at the normal hand operation position P3.

In this way, the timepiece 1 can easily push the crown 25 from the time correction position P4 to the normal hand operation position P3. Furthermore, the crown 25 located at the normal hand operation position P3 can be easily rotated in the clockwise direction. In addition to this configuration, the biasing force of the extrusion spring 33 is used, thereby enabling the crown male screw portion 77 to be easily screwed and coupled to the lock female screw portion 53.

In this manner, operability can be improved when the crown 25 is pushed from the time correction position P4 to the normal hand operation position P3 and further locked to the normal hand operation position P3.

The technical scope of the present invention is not limited to the above-described embodiment, and various modifications can be added thereto within the scope not departing from the gist of the present invention.

For example, in the above-described embodiment, as an example in which the crown 25 engages with the lock screw ring 32, an example has been described in which the crown male screw portion 77 of the crown 25 is screwed and coupled to the lock female screw portion 53 of the lock screw ring 32. However, the present invention is not limited thereto. As another example, the crown 25 can engage with the lock screw ring 32 by using a latch or a claw.

In addition, in the above-described embodiment, an example has been described in which the tip portion 64*a* of the winding stem screw portion 64 is screwed and coupled to the crown female screw portion 78. However, the present invention is not limited thereto. As another example, the tip portion of the winding stem can be fixed to the crown by using other means such as press fitting.

Alternatively, the female screw can be formed in the tip portion of the winding stem, and the male screw can be formed in the crown. The crown is screwed and coupled to the tip portion of the winding stem, thereby integrally fixing the winding stem and the crown.

Furthermore, in the above-described embodiment, an example has been described in which the pair of split groove portions 39 is formed in the winding stem pipe 22 and the pair of ear portions 54 is formed in the lock screw ring 32. However, the present invention is not limited thereto. As another example, the pair of ear portions can be formed in the winding stem pipe 22, and the groove portion can be formed in the lock screw ring 32.

In addition, in the above-described embodiment, an example has been described in which the coil-shaped extrusion spring 33 serves as the elastic member. However, the present invention is not limited thereto. As another example, a cylindrical rubber member can be used as the elastic member.

What is claimed is:

1. A crown lock mechanism-installed timepiece comprising:

a winding stem that is connected to a corrector lever of a movement;

a crown that is fixed coaxially to the winding stem and movable along an axial direction of the winding stem between a normal hand operation position and a time correction position;

a lock portion configured to engage with the crown and support the crown for movement along the axial direction;

an elastic member that biases the lock portion toward the crown; and a regulator configured to maintain the lock portion at a predetermined position against a biasing force of the elastic member so that the crown, while being engaged with the lock portion, to stay at the normal hand operation position.

2. The crown lock mechanism-installed timepiece according to claim 1, wherein a male screw is formed in one of the crown or the lock portion, and a female screw configured to engage with the male screw is formed in the other of the crown or the lock portion.

3. The crown lock mechanism-installed timepiece according to claim 2, wherein the crown and the lock portion are configured so that the crown and the lock portion are pressed against each other by means of the biasing force of the elastic member when the crown is disposed at the normal hand operation position and disconnected from the lock portion.

4. The crown lock mechanism-installed timepiece according to claim 1, wherein the biasing force of the elastic member is set to be weaker than a holding force of the corrector lever for holding the crown at the normal hand operation position when the crown and the lock portion are disconnected from each other.

5. The crown lock mechanism-installed timepiece according to claim 1, wherein the crown and the the lock portion are configured such that when the crown is disposed at the time correction position, the crown is separated from the lock portion.

6. The crown lock mechanism-installed timepiece according to claim 1, wherein the regulator comprises a pair of groove portions formed along the axial direction, and a pair of ear portions formed as a part of the lock portion, wherein the pair of ear portions are slidably disposed in the pair of groove portions, respectively, and wherein the lock portion is maintained at the predetermined position by the pair of ear portions being into contact with the pair of groove portions.

* * * * *